US008313050B2

(12) United States Patent
Hall et al.

(10) Patent No.: US 8,313,050 B2
(45) **Date of Patent: *Nov. 20, 2012**

(54) DIAMOND NOZZLE

(75) Inventors: David R. Hall, Provo, UT (US); David Wahlquist, Spanish Fork, UT (US); Thomas Morris, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 19 days.

This patent is subject to a terminal disclaimer.

(21) Appl. No.: 12/819,223

(22) Filed: Jun. 20, 2010

(65) Prior Publication Data

US 2011/0011957 A1 Jan. 20, 2011

Related U.S. Application Data

(62) Division of application No. 11/747,341, filed on May 11, 2007, now Pat. No. 7,757,971.

(51) Int. Cl.
*B05B 1/00* (2006.01)

(52) U.S. Cl. ..... 239/591; 239/595; 239/596; 239/597; 239/DIG. 19; 451/102

(58) Field of Classification Search ..... 239/591, 239/596, 597, 595, 600, DIG. 19; 175/393, 175/417; 451/102.75
See application file for complete search history.

(56) References Cited

U.S. PATENT DOCUMENTS

| | | | | |
|---|---|---|---|---|
| 1,988,432 | A * | 1/1935 | Gillett et al. | 451/102 |
| 3,178,120 | A | 4/1965 | Kappel | |
| 4,528,782 | A | 7/1985 | Bean | |
| 4,555,872 | A * | 12/1985 | Yie | 451/40 |
| 4,817,874 | A * | 4/1989 | Jarzebowicz | 239/434 |
| 5,365,702 | A | 11/1994 | Shank, Jr. | |
| 5,785,582 | A | 7/1998 | Stefanik et al. | |
| 5,794,858 | A * | 8/1998 | Munoz | 239/433 |
| 5,851,139 | A * | 12/1998 | Xu | 451/102 |
| 6,425,805 | B1 | 7/2002 | Massa et al. | |
| 6,817,550 | B2 | 11/2004 | Taylor | |
| 7,757,971 | B2 * | 7/2010 | Hall et al. | 239/591 |

* cited by examiner

*Primary Examiner* — Dinh Q Nguyen
(74) *Attorney, Agent, or Firm* — Osha Liang LLP

(57) ABSTRACT

In one aspect of the invention, an abrasion resistant nozzle has at least two sintered diamond bodies having flat, mating, exterior surfaces and a thickness, the surfaces being held against each other under compression. An enclosure is formed between the mating surfaces, at least one surface having a groove forming a portion of the enclosure and the other surface forming a remaining portion of the enclosure. The enclosure connects an entry and an exit formed in at least one side of at least one of the bodies.

18 Claims, 10 Drawing Sheets

DIAMOND NOZZLE

PRIORITY CLAIM

This application is a divisional of U.S. patent application Ser. No. 11/747,341 filed on May 11, 2007, which issued Jul. 20, 2010 as U.S. Pat. No. 7,757,971.

BACKGROUND OF THE INVENTION

This invention relates to fluid nozzles used to clean, abrade, or cut materials or surfaces in industries such as road milling and resurfacing, downhole drilling, water jet cutting, coal furnaces, or other industries where fluids or micronized materials are emitted from nozzles. In such applications, the nozzles are often subjected to high temperatures, pressures, and/or abrasive materials or fluids and therefore experience a high amount of wear. For this reason, an abrasion resistant nozzle may be desired in order to prolong the life of the nozzle, which may lower cost for replacement and maintenance.

U.S. Pat. No. 4,528,782 to Bean, which is herein incorporated by reference for all that it contains, discloses an angular blasting nozzle having a replaceable section that substantially exclusively intercepts and turns abrasive flow from an inlet flow path to an obtuse outlet flow path. The nozzle is conveniently formed of a pair of mating, rectangular, prismatic sections which are well suited for fabrication from long-wearing materials such as tungsten carbide.

U.S. Pat. No. 6,817,550 to Taylor et al., which is herein incorporated by reference for all that it contains, discloses a nozzle with a longitudinal tubular body with an inner conduit or bore and a tapered distal dispensing end. A metal restraining shoulder at the proximal end can be used to fit the nozzle in a spray apparatus. The nozzle includes a substrate such as WC or CoCr or other suitable material and a diamond inner rod.

BRIEF SUMMARY OF THE INVENTION

In one aspect of the invention, an abrasion resistant nozzle has at least two sintered diamond bodies having flat, mating, exterior surfaces and a thickness, the surfaces being held against each other under compression. An enclosure is formed between the mating surfaces, at least one surface having a groove forming a portion of the enclosure and the other surface forming a remaining portion of the enclosure. The enclosure connects an entry and an exit formed in at least one side of at least one of the bodies.

The nozzle may comprise a band shrink fit around at least a portion of the two mating surfaces. The shrink fit may comprise an interference of 0.0001 to 0.002 inches. The nozzle may be a fluidic nozzle. The mating flat surfaces may be held under a compressive load of at least 2000 psi. The diamond bodies may comprise a thickness of at least 0.050 inches. The bodies may be compressively disposed within a chamber comprising a threaded plug. The nozzle may comprise an exit narrower than the entry. The enclosure may connect the entry and a plurality of exits. The entry and exit may be formed in the same side of one of the bodies. The entry and exit may be formed in different sides of one of the bodies. The entry and exit may be formed in different bodies. The diamond bodies may be closed and/or solid.

The groove may comprise a varied depth and/or width. The other surface may also comprise a groove forming the remaining portion of the enclosure. The groove may be substantially straight. At least a portion of the groove may be laser formed. At least a portion of the groove may be formed using an electric discharge machine.

The diamond may be sintered to a hard material selected from the group consisting of tungsten carbide, a cemented metal carbide, niobium carbide, silicon carbide, or combinations thereof.

In another aspect of the invention, an abrasion resistant nozzle may comprise a plurality of sintered diamond bodies, each comprising at least one flat, mating, exterior surface and a thickness, each mating surface being held against another surface under compression such that there are at least two pairs of mating surfaces. An enclosure may be formed in the plurality of bodies, at least one surface of each pair of mating surfaces comprising a groove forming a portion of the enclosure and the other surface of the mating surfaces forming a remaining portion of the enclosure. The enclosure may connect an entry and an exit formed in at least one side of at least one of the bodies. The surface may be diamond, cubic boron nitride, a cemented metal carbide or a combination thereof.

In some embodiments, the diamond may be sintered in a high pressure high temperature press to a carbide substrate. In some embodiments, the diamond may be formed around a carbide core, which may be grit blasted out to form the groove. In some embodiments, the groove may polished by flowing an abrasive material through the groove.

It should be noted for purposes of this application that the term "fluidic nozzle" describes the nozzle that causes at least two streams to interact with each other.

FIG. **12*a*** is a cross-sectional diagram of another embodiment of sintered diamond bodies with mated surfaces.

Figure 13:
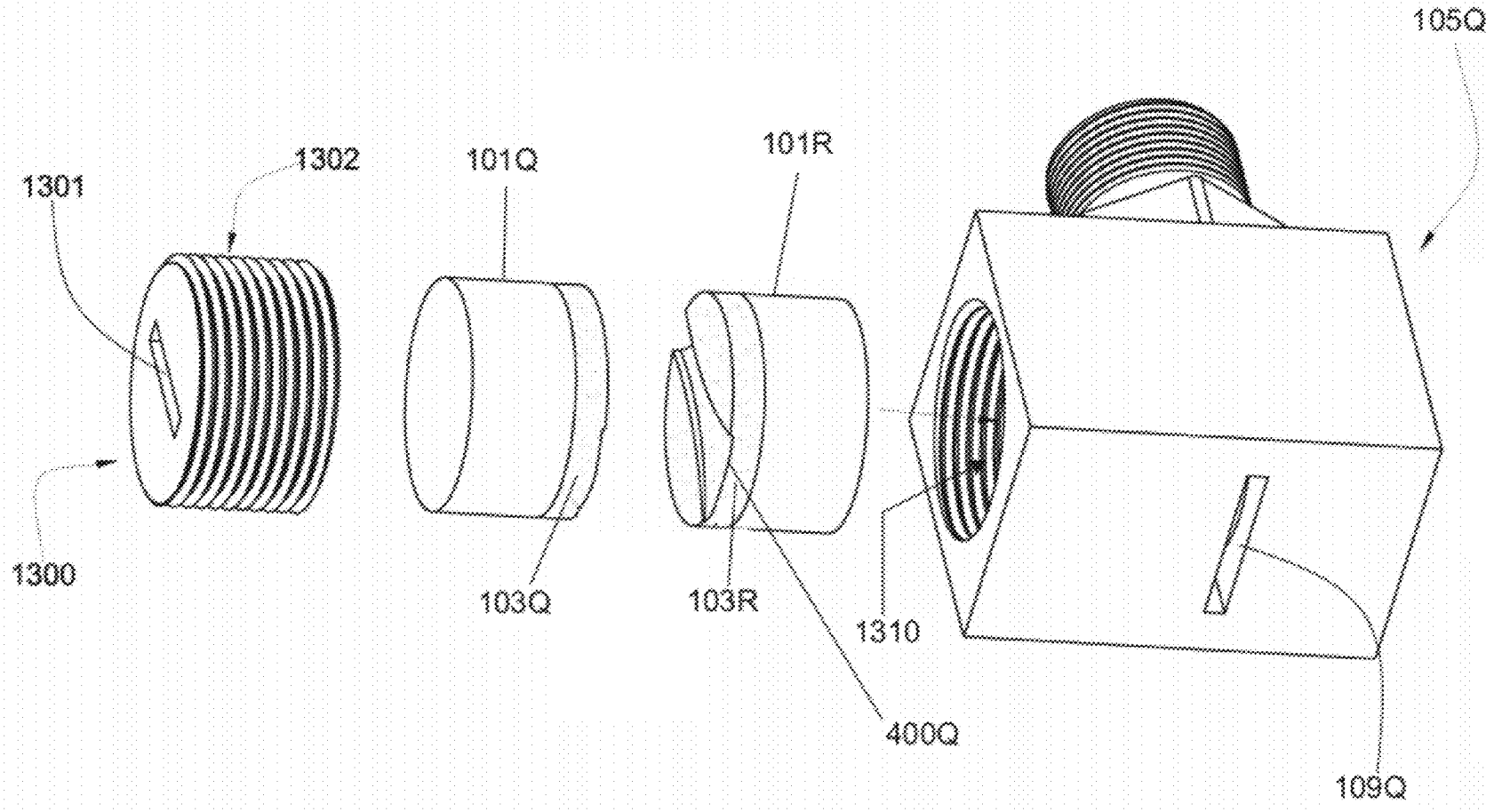

FIG. 13 is an exploded diagram of another embodiment of a nozzle.

Figure 14:
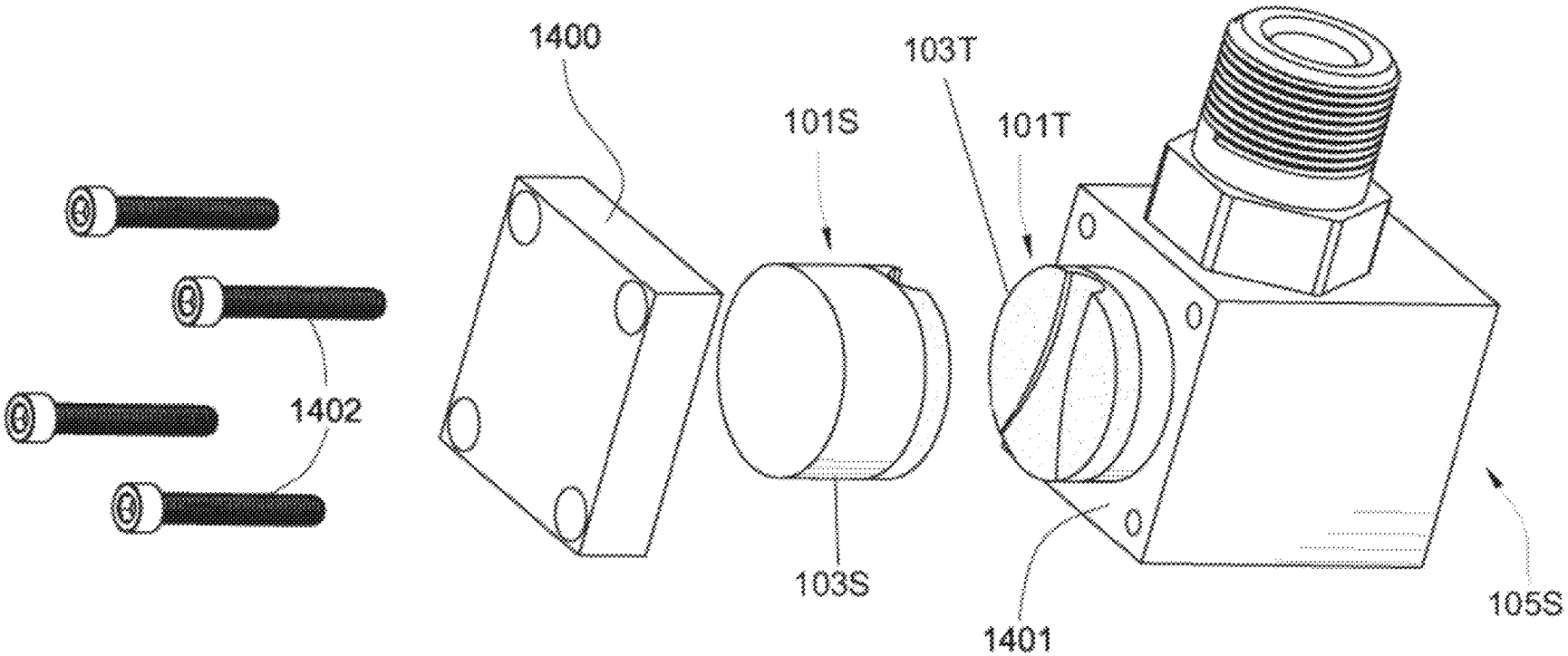

FIG. 14 is an exploded diagram of another embodiment of a nozzle.

Figure 15:
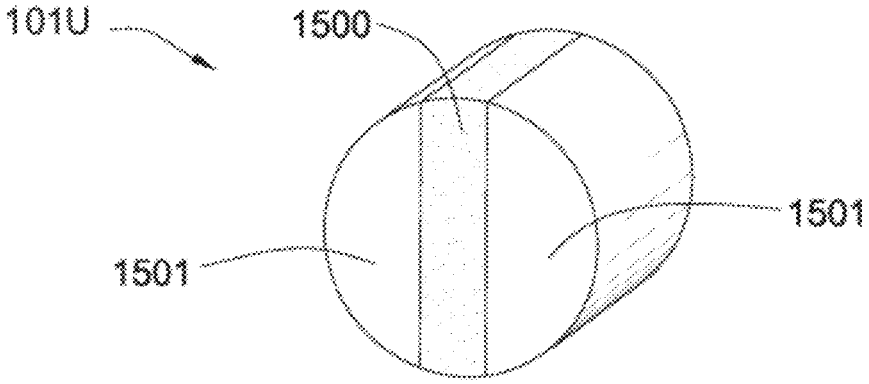

FIG. 15 is a perspective diagram of another embodiment of a nozzle.

Figure 16:
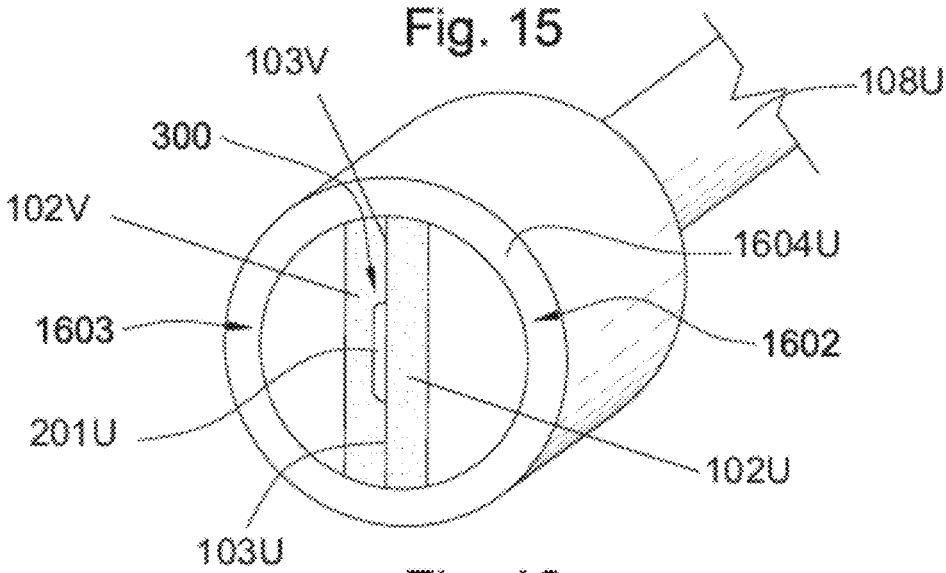

FIG. 16 is a perspective diagram of another embodiment of a nozzle.

Figure 17:
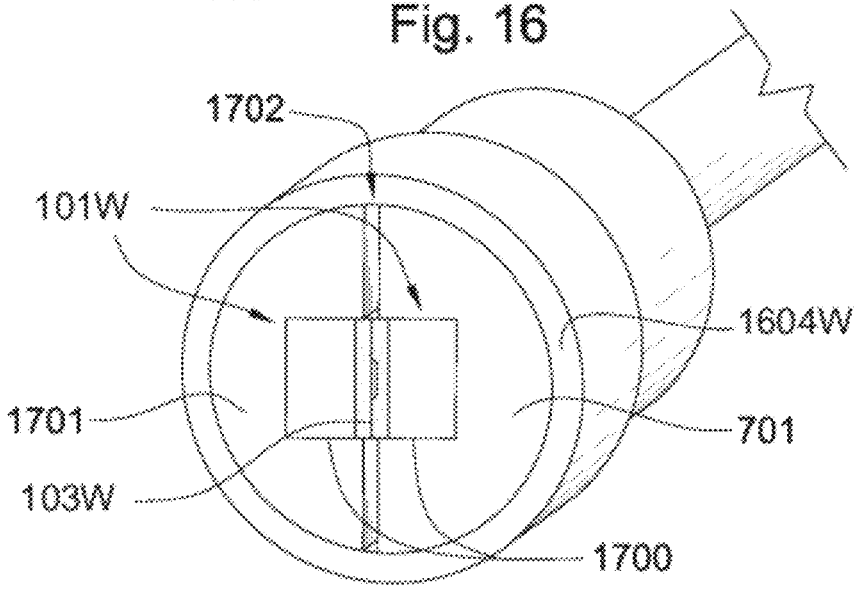

FIG. 17 is a perspective diagram of another embodiment of a nozzle.

Figure 18:
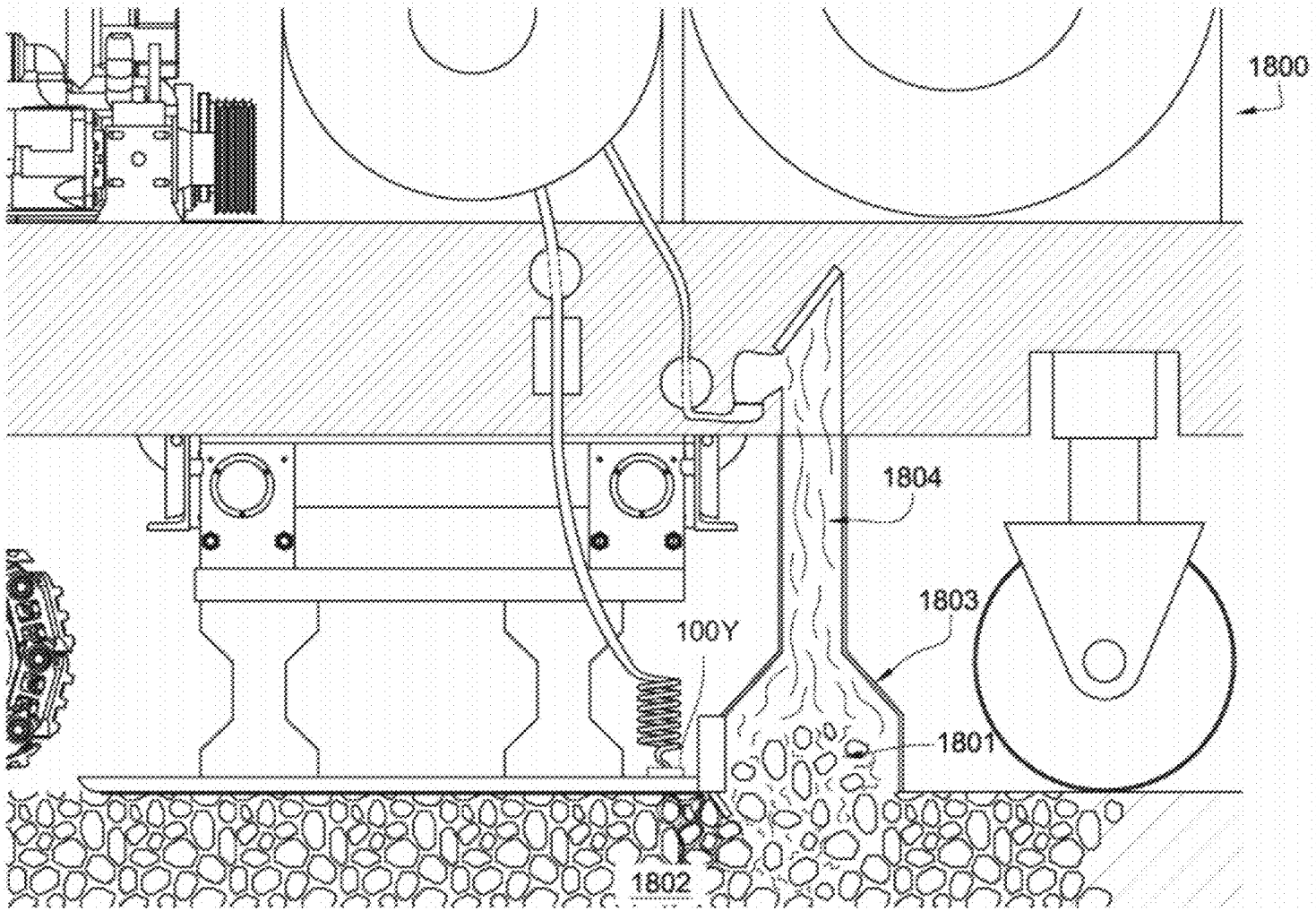

FIG. 18 is a cross-sectional diagram of an embodiment of an asphalt milling machine.

Figure 19:
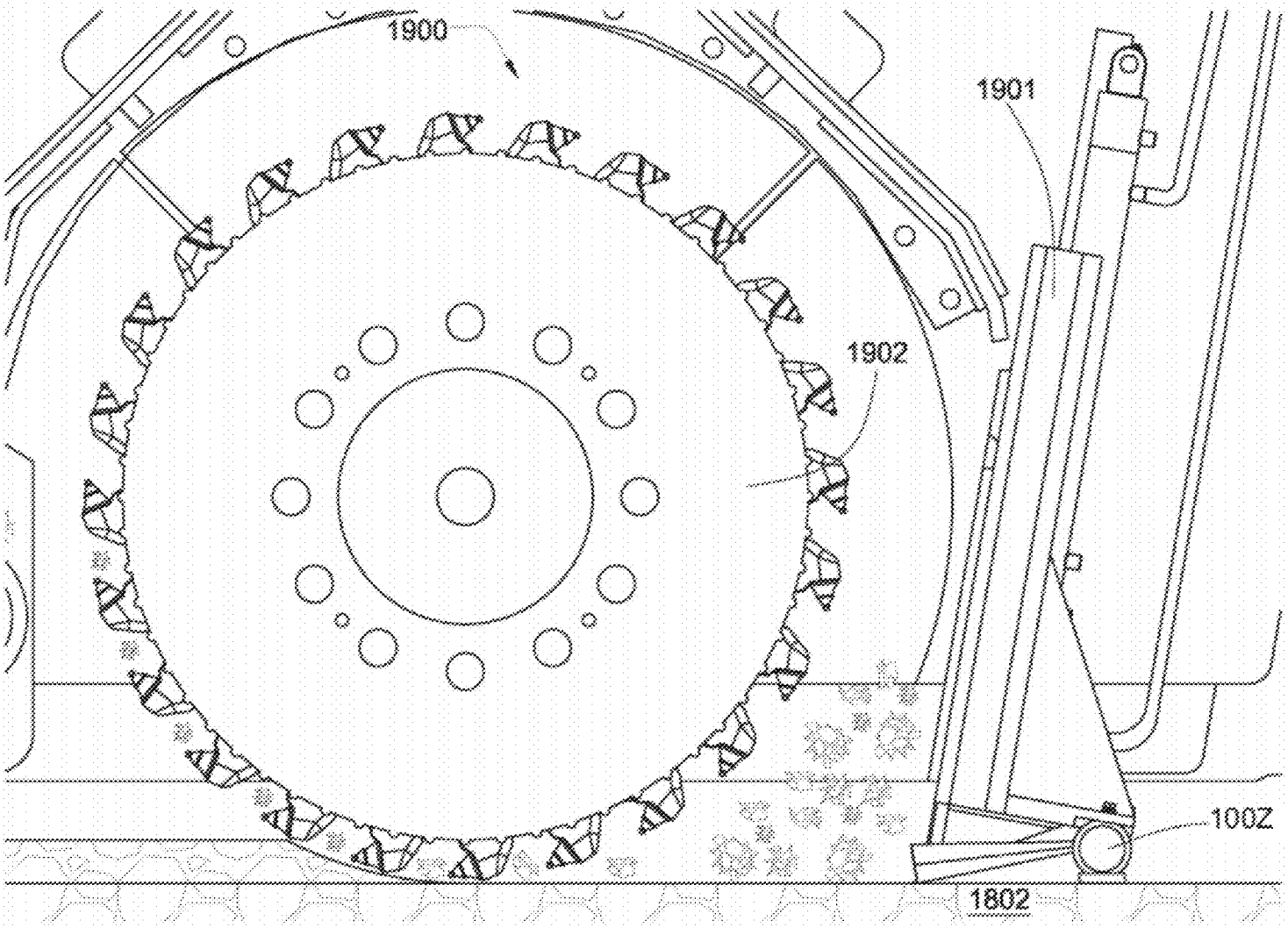

FIG. 19 is a cross-sectional diagram of another embodiment of a pavement milling machine.

Figure 20:
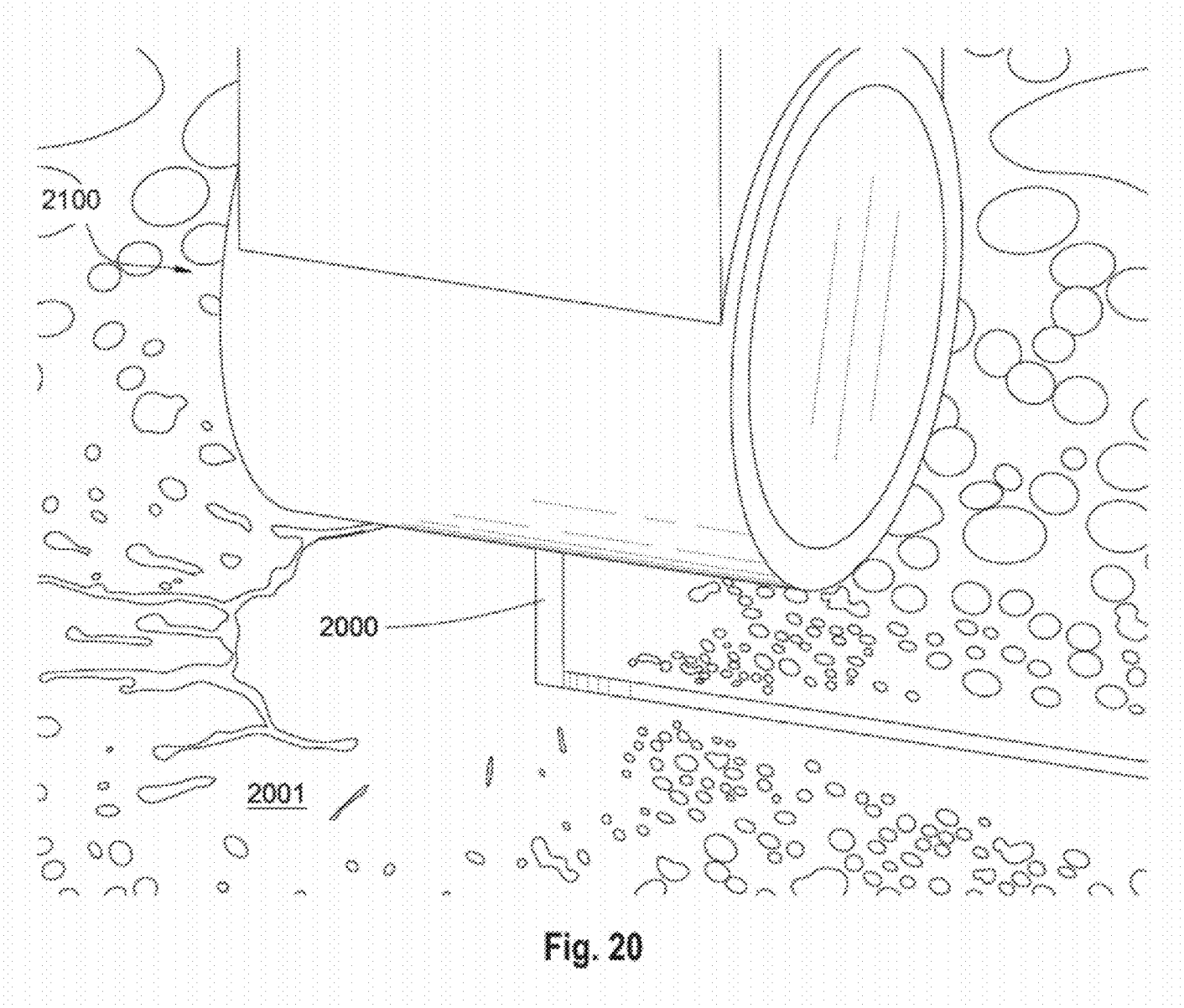

FIG. 20 is a perspective diagram of a water cutting apparatus.

DETAILED DESCRIPTION

Figure 1:
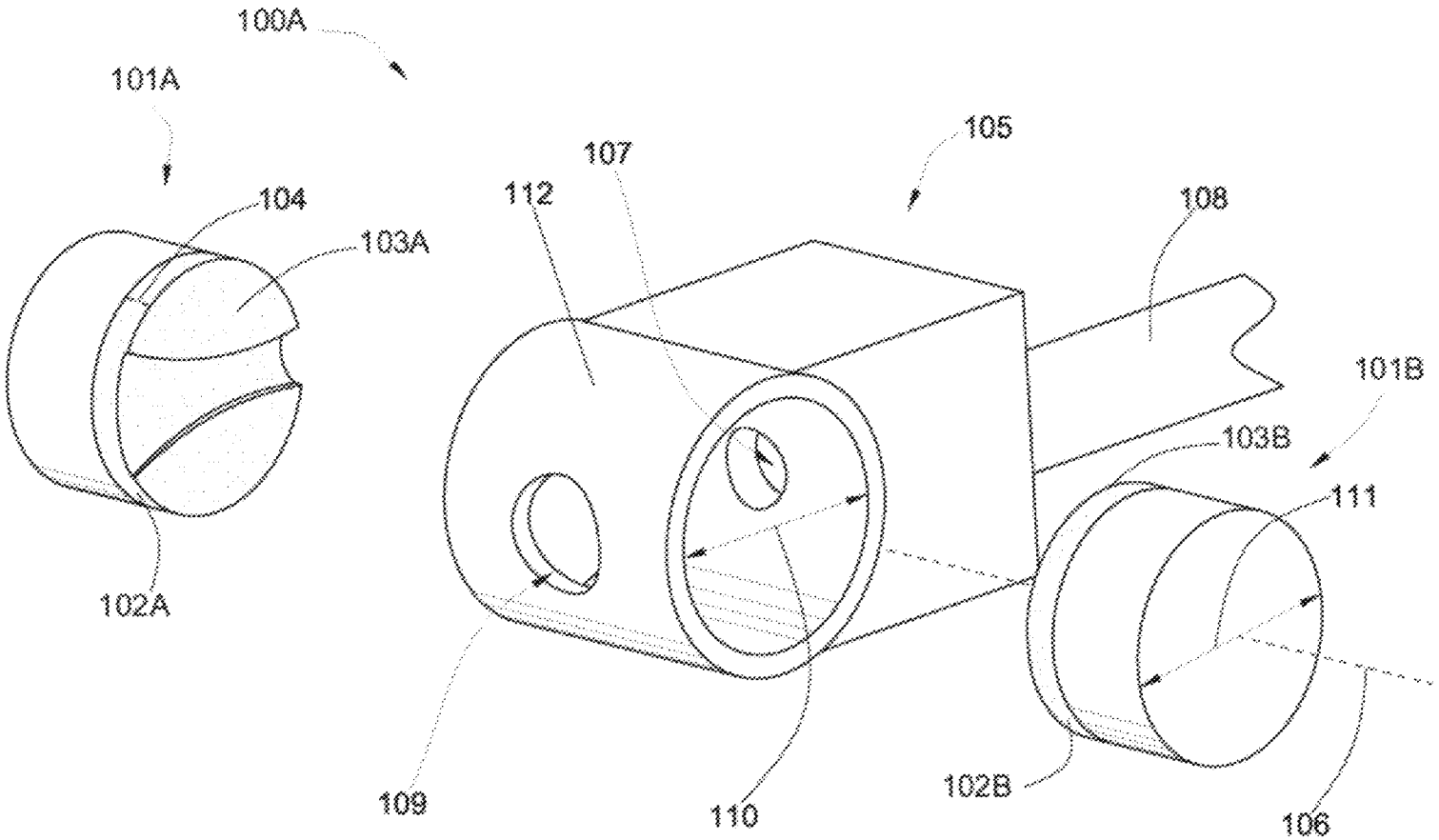
FIG. 1 is an exploded diagram of an embodiment of a nozzle.

FIG. 1 is an exploded diagram of an embodiment of nozzle 100 having abrasion resistance, wherein the current invention may be used. The nozzle 100 comprises inserts 101A, 101B, wherein each of the inserts 101A, 101B comprise sintered diamond bodies 102A, 102B having flat, mating, exterior surfaces 103A, 103B and a thickness 104. A cylindrical band 112, of a nozzle casing 105 may be shrink fit around the inserts 101A, 101B such that the mating surfaces 103A, 103B are held against each other under compression with a compressive load of 2000 psi. In this embodiment, the compression is radial with respect to a longitudinal axis 106 of the inserts 101A, 101B. Under compression, the mating surfaces 103A, 103B form an enclosure (See no. 300 in FIG. 3) through which fluid may pass. The fluid may pass through a first bore 107 in the nozzle casing 105 from a fluid source or conduit 108 attached to the casing 105 at a back portion of the casing 105. The casing 105 also comprises a second bore 109 in the cylindrical band 104, allowing the fluid to exit the nozzle 100. The fluid may be at a high pressure and/or velocity.

The nozzle casing 105 may be made of steel or other hard material. The nozzle casing 105 may be heated until an inside diameter 110 of the cylindrical band 104 increases to a size larger than a diameter 111 of the inserts 101A, 101B, such that the inserts 101A, 101B may be inserted into the cylindrical band 104. As the nozzle casing 105 cools, a shrink fit is created around the diameter 111 of the inserts 101A, 101B which may comprise an interference of 0.0001 to 0.002 inches.

Figure 2:
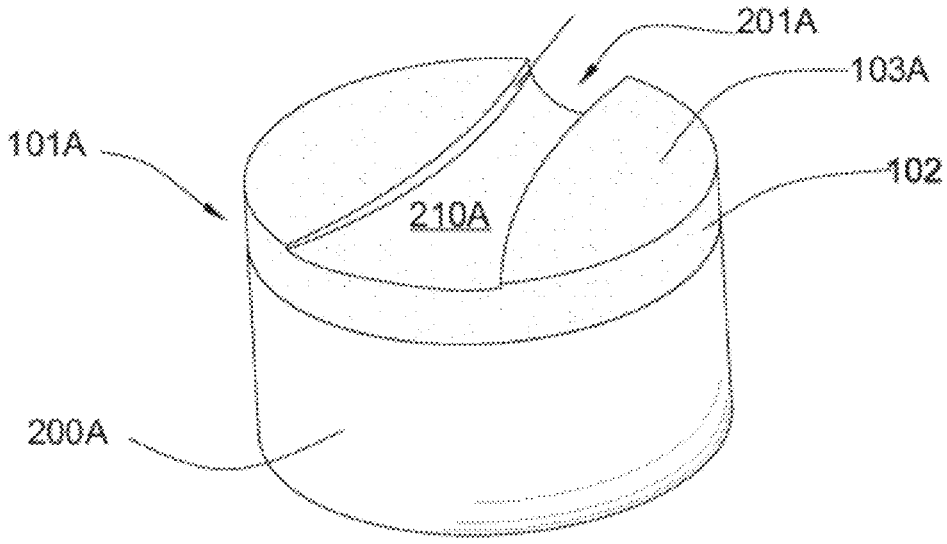
FIG. 2 is a perspective diagram of an embodiment of a sintered diamond body.

FIG. 2 illustrates the insert 101A of FIG. 1. The sintered diamond body 102A may be sintered to a hard material 200A. The hard material 200A may be selected from the group consisting of tungsten carbide, a cemented metal carbide, niobium carbide, and silicon carbide.

Figure 3:
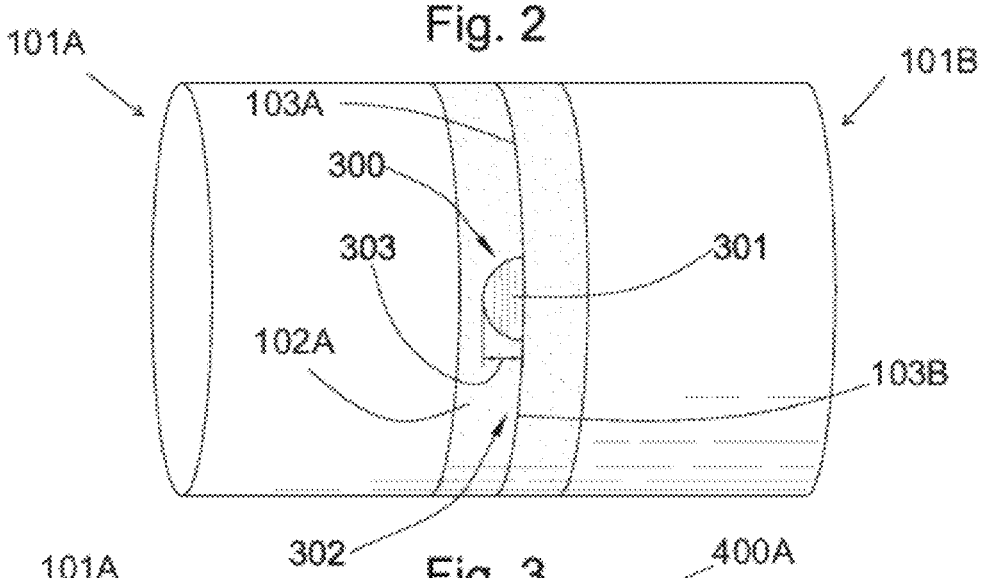
FIG. 3 is a perspective diagram of an embodiment of sintered diamond bodies with mated surfaces.

The flat, mating surface 103A may have a groove 201A which forms a portion of an enclosure 300 as shown in FIG. 3. The groove 201A may be formed using an electric discharge machine, a laser, or other method for cutting diamond. The groove 201A is formed generally along the mating surface 103A and generally has two groove side walls 205 connected by a groove bottom 210A. In some embodiments, the groove bottom 210A is closed forcing the fluid to pass along and between the mating surfaces 103A, 103B. In some embodiments, it may be desirable to form a concave, flat, sharp, round, and/or convex generally shaped groove bottom 210A to manipulate the flow within the enclosure.

Figure 4:
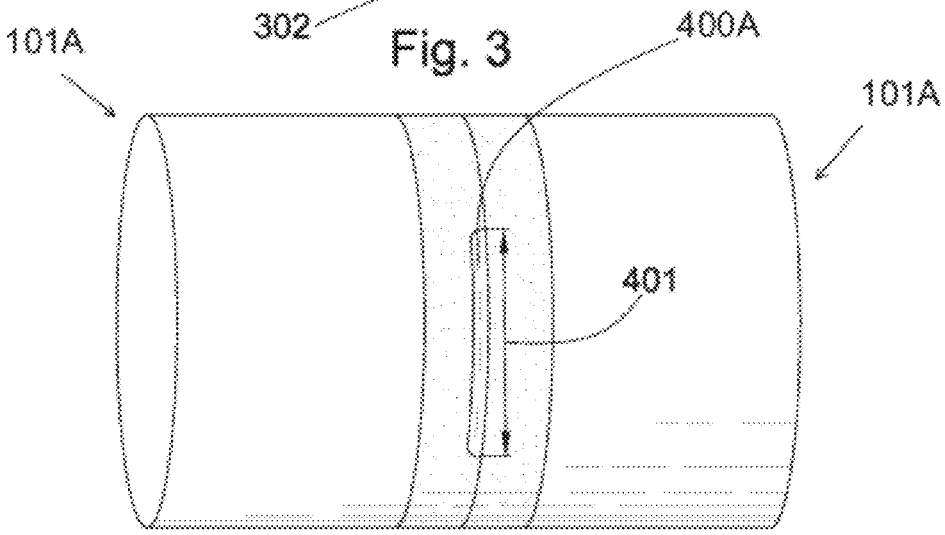
FIG. 4 is a perspective diagram of another embodiment of sintered diamond bodies with mated surfaces.

Referring to FIGS. 3 and 4, insert 101A and insert 101B are shown with mating surface 103A adjacent mating surface 103B. Mating surface 103B forms a remaining portion of the enclosure 300. In some embodiments, the mating surface is part of a solid diamond body (not shown). In other embodiments, the mating surface is part of a closed diamond body (not shown). The enclosure 300 also connects an entry 301 and an exit 400 where the groove 201A extends to a side 302 of one of the bodies 102A, 102B. The side 302 may be an outer circumference of a cylinder as shown in FIG. 3 and FIG. 4. The groove 201A may comprise a varied depth 303 and/or width 401, which may be advantageous for different applications of the current invention. In the current embodiment, the entry 301 comprises a greater depth 303 and narrower width 401 than the exit 400. This may direct the fluid to fan out upon exiting the nozzle 100A, such that the fluid covers a greater area.

Figure 5:
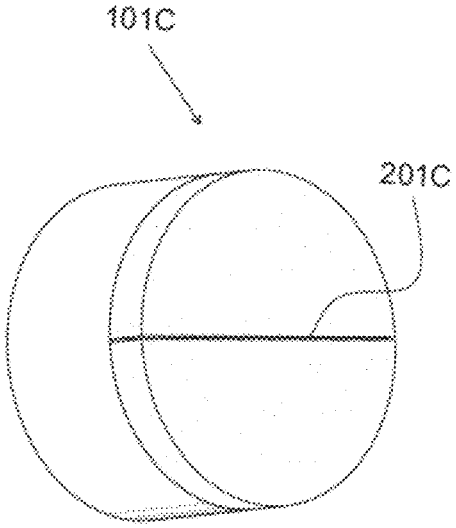
FIG. 5 is a perspective diagram of another embodiment of a sintered diamond body.

Referring to FIG. 5, an embodiment of an insert 101C includes forming a groove 201C using a laser, which may allow the groove 201C to be a narrow slit.

Figure 6:
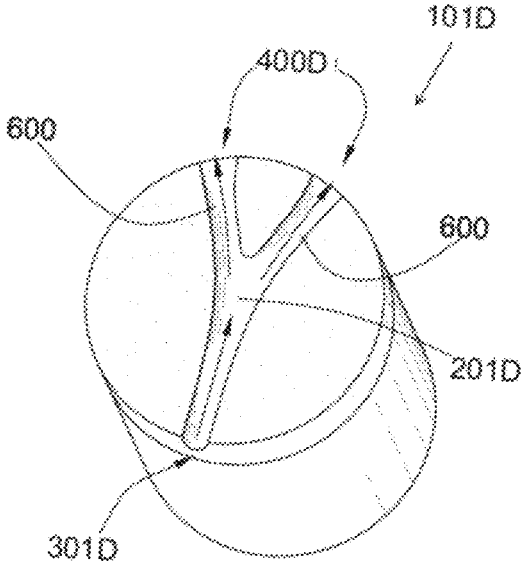
FIG. 6 is a perspective diagram of another embodiment of a sintered diamond body.

Referring to FIG. 6, an embodiment of an insert 101D includes a groove 201D that may connect an entry 301D with a plurality of exits 400D through diverging pathways 600 in the groove 201D. The plurality of exits 400D may allow the fluid to cover a larger area than a single exit such as the single exit 400 of FIG. 4.

Figure 7:
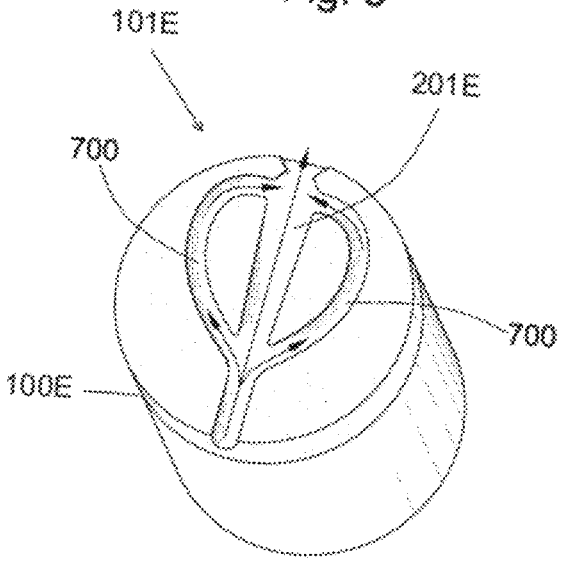
FIG. 7 is a perspective diagram of another embodiment of a sintered diamond body.

Referring to FIG. 7, an embodiment of an insert 101E includes a groove 201E that may comprise a plurality of side channels 700 which may allow a nozzle 100E to be a fluidic nozzle. Fluid flowing through the side channels 700 may change the direction of the fluid exiting the nozzle 100E in an oscillating pattern.

Figure 8:
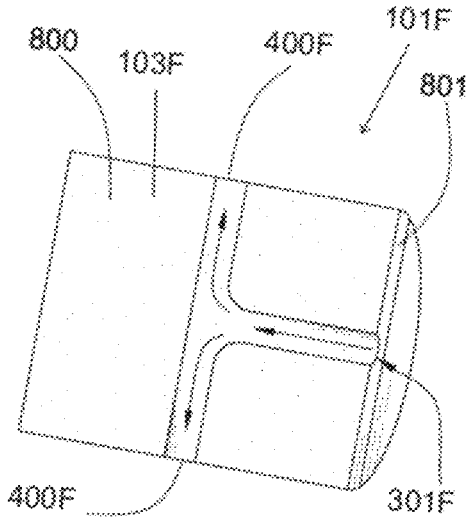
FIG. 8 is a perspective diagram of another embodiment of a sintered diamond body.

Referring to FIG. 8, an embodiment of an insert 101F includes a flat, mating surface 103F that may comprise any shape, such as the rectangular shaped surface. The entry 301F may be formed in a different side 801 than the exit 400F. Exits 400F may also be formed in different sides, though the exits 400F may be formed in the same side. The entry 301F may also be formed in the same side as an one exit.

Figure 9:
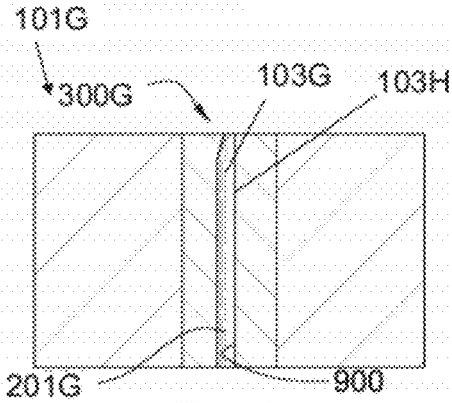
FIG. 9 is a cross-sectional diagram of another embodiment of sintered diamond bodies with mated surfaces.

Referring to FIG. 9, an embodiment of an insert 101G includes an enclosure 300G that may be formed by a groove 201G in one mating surface 103G and a flat area 900 of the other mating surface 103H.

Figure 10:
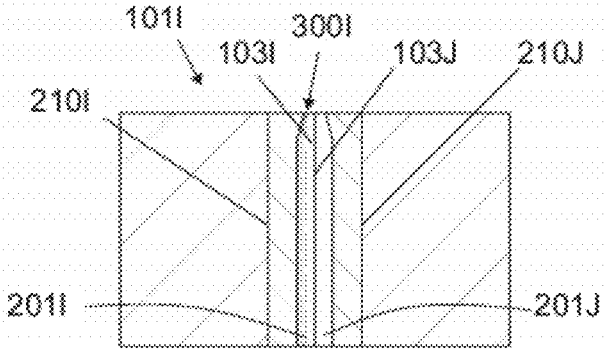
FIG. 10 is a cross-sectional diagram of another embodiment of sintered diamond bodies with mated surfaces.

Referring to FIG. 10, an embodiment of an insert 101I includes an enclosure 300I that may be formed by groove 201I having a first groove bottom 210I and groove 201J having a second groove bottom 210J in each of the mating surfaces 103I, 103J.

Figure 11:
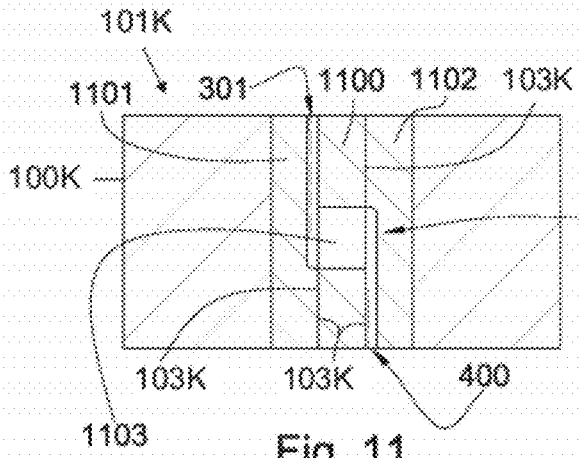
FIG. 11 is a cross-sectional diagram of another embodiment of sintered diamond bodies with mated surfaces.

Referring to FIG. 11, an embodiment of an insert 101K includes a nozzle 100K that may comprise a plurality of diamond bodies 1100, 1101, 1102, each comprising at least one mating surface 103K being held against another mating surface 103K under compression. A third body 1100 comprising two mating surfaces 103K may be intermediate two other bodies 1101,1102, such that there are two pairs of mating surfaces 103K. The third diamond body 1100 may initially have been bonded to a hard material, but it may be ground off before the body 1100 is placed intermediate the other bodies 1101, 1102. The third body 1100 may comprise a bore 1103 forming a portion of the enclosure 300K. The entry 301K and exit 400K may be formed in separate bodies.

Figure 12:
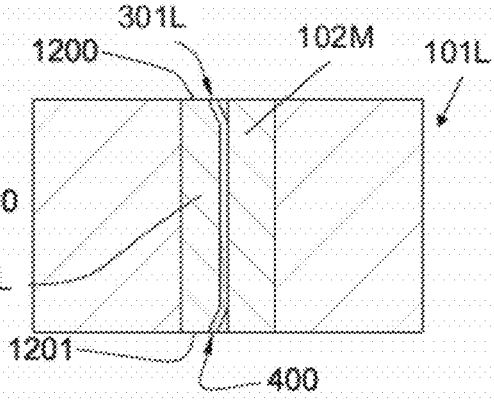
FIG. 12 is a cross-sectional diagram of another embodiment of sintered diamond bodies with mated surfaces.
Figure 12A:
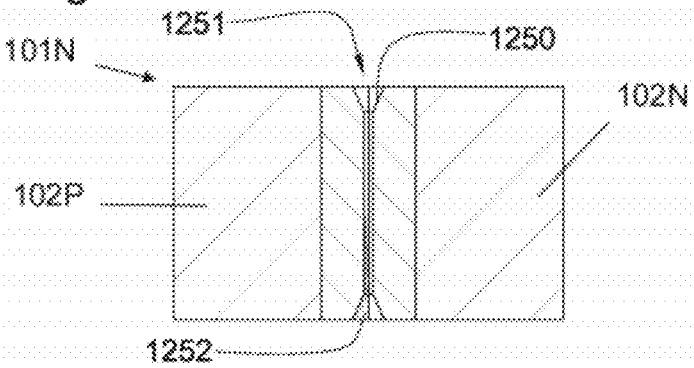

Referring to FIG. 12, an embodiment of an insert 101L includes an entry 301L that may be formed entirely in one side 1200 of one of the diamond bodies 102L, 102M. The exit 400L may also be formed entirely in another side 1201 of one of the diamond bodies 102L, 102M. FIG. 12*a* discloses at least one of diamond bodies 102N, 102P having a chamfer 1250. A chamfer 1250 provides the advantage of mitigating stress that may be induced from shrink fitting a casing around the diamond bodies 102N, 102P. A gap 1251 formed by the chamfer 1250 may be filled with a wear resistant material 1252 that may deform and seal off the gap 1251 during the shrink fitting process to prevent leaking.

In some embodiments, it may be desirable to form an exit or an entry of an enclosure on a flat formed into an edge a diamond body.

Referring to FIG. 13, an embodiment of an insert 101N includes mating surfaces 1030, 103 R that may be compressively held together within a chamber 1310 of a nozzle casing 105Q by a threaded plug 1300, as in the embodiment of FIG. 13. Inserts 101Q, 101R may be inserted into chamber 1310 such that an exit 400Q is aligned with a bore 109Q in a bottom of the casing 105Q where the fluid may exit. The bore 109Q may be shaped to match the exit 400Q. The plug 1300 may comprise a depression 1301 in an outer surface such that the plug 1300 may be tightened in order to place the surfaces 103 under the desired amount of compression. The thread 1302 on the plug 1300 may comprise a pitch such that a linear force against the plug 1300 due to the compression of the surfaces 103Q, 103R does not cause the plug 1300 to rotate.

Referring to the embodiment of FIG. 14, the nozzle casing 105S may include a plate 1400 fastened to a side 1401 of the nozzle casing 105S. The plate 1400 may be fastened to the nozzle casing 105S by a plurality of fasteners 1402 such as screws in order to provide the desired compression on the mating surfaces 103S, 103T inside a chamber (not shown) of the nozzle casing 105S. A portion of one of the inserts 101S, 101T may extend beyond the side 1401 of the nozzle casing 105S, such that the plate 1400 may apply a force on the inserts 101S, 101T. The plate 1400 may be made of a thick, hard metal designed to withstand outward forces due to the inserts 101S, 101T being under compression.

Referring now to the embodiment of FIGS. 15 and 16, sintered diamond bodies 102U, 102V may be formed from a single insert 101U. The insert 101U may have a solid region 1500 of sintered diamond intermediate two regions 1501 of hard material. The insert 101U may be cut at the diamond region 1500, resulting in two halves 1602, 1603 having two diamond bodies 102U, 102V, each having a rectangular mating surface 103U, 103V. A groove 201U may then be formed into one of the mating surfaces 103U, 103V, such that placing the two halves 1602, 1603 of the insert 101U back together forms the enclosure 300U. The halves 1602, 1603 may be held under compression by a band 1604U, which may be shrink fit around the halves 1602, 1603. A fluid conduit 108U may attach to a portion of the band 1604U.

Referring to FIG. 17, inserts 101W, 101X may be disposed within recesses 1700 in a pair of cylindrical halves 1701. A band 1604W may be shrink fit around the cylindrical halves 1701, causing the mating surfaces 103W, 103X of the inserts 101W, 101X to be held together compressively. A gap 1702 may separate the cylindrical halves 1701 before compression is applied, which may allow the mating surfaces 103W, 103X to bear the compressive load.

Referring to FIG. 18, embodiments may be used in road resurfacing machines, such as the machine 1800 in the embodiment of FIG. 18. The nozzles 100Y may be used to emit a fluid under high pressure such that aggregate 1801 pops out of the asphalt surface 1802 into a depressurization chamber 1803, where resurfacing materials 1804 may be added and the aggregate is re-compacted into a new road. Such a system is described in U.S. patent application Ser. Nos. 11/470,570 and 11/558,605 which are herein incorporated by reference for all that they contain.

Referring to FIG. 19, a nozzle 100Z of the current invention may be used in pavement milling machine 1900. The nozzles 100Z may be placed on a moldboard 1901 proximate the asphalt surface 1802 and behind a rotary milling drum 1902 in order to clean the milled pavement surface 1802. In this embodiment, a nozzle 100Z with a wide effective spray area may be desirable. Such a system is described in U.S. patent application Ser. Nos. 11/566,151 and 11/668,390 which are herein incorporated by reference for all that they contain.

Referring to FIG. 20, a nozzle 2100 may also be used in water jet cutting applications. The nozzle 2100 may be designed to emit a narrow stream 2000 of fluid, which may be a mixture of water and abrasive materials, at extremely high pressures, as much as 30,000 to 60,000 psi or more, in order to cut hard surfaces 2001 or materials. Due to the abrasion resistance of the diamond bodies, these nozzles may last longer than typical water jet nozzles of the prior art.

The abrasion resistant nozzles may also be used in coal furnaces; downhole drill bits such as percussion bits, shear bits, rotary drag bits, or roller cone bits; homogenizers; or other applications where heat or abrasive materials are used.

Whereas the present invention has been described in particular relation to the drawings attached hereto, it should be understood that other and further modifications apart from those shown or suggested herein, may be made within the scope and spirit of the present invention.

What is claimed is:

1. An abrasion resistant nozzle, comprising:

a first body having a first mating surface, said first mating surface including a groove having a bottom formed therein, said groove extending to a side of said first mating surface;

a second body having a second mating surface, said second being positioned such that said second mating surface is adjacent said first mating surface;

an enclosure formed by at least said bottom of said groove and a portion of said second mating surface, said enclosure having at least an entry at said side of said first mating surface where said groove extends;

a nozzle casing, said nozzle casing including:

a receiving means into which said first body and said second body are received;

a compression means to compress said first body and said second body together; and, a bore substantially aligned with said entry.

2. The nozzle of claim 1, wherein said groove further comprises a first side wall and a second side wall spaced apart from said first side wall, said first side wall and said second side wall each abutting said bottom.

3. The nozzle of claim 1, wherein said second mating face includes a second groove having another bottom formed therein, said another bottom of said second groove forming said portion of said second mating surface that forms said enclosure.

4. The nozzle of claim 1, wherein said receiving means is a band around said first body and said second body and said compression means is said band configured to be shrink fit around said first body and said second body.

5. The nozzle of claim 1, wherein said receiving means is a chamber formed within said nozzle casing.

6. The nozzle of claim 5, and said compression means is a plug received within said chamber, said plug configured to compress said first body and said second body together.

7. The nozzle of claim 6, wherein said chamber includes an internal thread and said plug is threaded.

8. The nozzle of claim 5, wherein said compression means is a plate secured to said nozzle casing.

9. The abrasion resistant nozzle of claim 5 wherein said means for urging said first insert and said second insert together is a plate secured to said nozzle casing.

10. The nozzle of claim 1, wherein said enclosure has an exit connected to said entry and wherein said nozzle casing includes another bore substantially aligned with said exit.

11. The nozzle of claim 1, wherein at least one of said first body and said second body is formed from a material selected from the group consisting of tungsten carbide, a cemented metal carbide, niobium carbide, and silicon carbide.

12. An abrasion resistant nozzle, comprising:

a nozzle casing having a chamber, said nozzle casing having at least one outlet bore;

a first insert disposed within said chamber, said first insert including a first surface having a groove formed therein, said first insert being orientated within said chamber such that said outlet bore is substantially aligned with an exit portion of said groove;

a second insert disposed within said chamber, said second insert including a second surface, said second insert being orientated within said chamber such that said first surface of said first insert faces said second surface said second insert; and a means for urging said first insert and said second insert together.

13. The abrasion resistant nozzle of claim 12, wherein said means for urging said first insert and second insert together is a plug inserted into said chamber.

14. The abrasion resistant nozzle of claim 13, wherein said chamber has an internal thread and wherein said plug inserted into said chamber is a threaded plug.

15. The abrasion resistant nozzle of claim 12, wherein said means for urging said first insert and said second insert together is a plate secured to said nozzle casing.

16. The abrasion resistant nozzle of claim 12, wherein said second surface includes another groove formed therein, said another groove configured to be in fluid communication with said groove.

17. The abrasion resistant nozzle of claim 16, wherein said groove further comprises a bottom, a first side wall, and a second side wall spaced apart from said first side wall, said first side wall and said second side wall each abutting said bottom.

18. The abrasion resistant nozzle of claim 12, wherein at least one of said first insert and said second insert is formed from a material selected from the group consisting of tungsten carbide, a cemented metal carbide, niobium carbide, and silicon carbide.

* * * * *